United States Patent [19]

Young et al.

[11] Patent Number: 5,044,558

[45] Date of Patent: Sep. 3, 1991

[54] BURNER NOZZLE WITH REPLACEABLE AIR JETTING ASSEMBLY

[75] Inventors: Timothy M. Young, Coppell; Charles D. Coppedge, Euless; Charles S. McCasland, Westminister, all of Tex.

[73] Assignee: Halliburton Company, Duncan, Okla.

[21] Appl. No.: 350,105

[22] Filed: May 9, 1989

[51] Int. Cl.[5] ..... A62C 31/02; F23D 14/62

[52] U.S. Cl. ..... 239/391; 239/403; 239/424.5; 239/600; 431/8; 431/10; 431/187; 431/354

[58] Field of Search ..... 431/354, 8, 187, 182, 431/9, 10; 239/403, 419, 427.3, 417, 417.3, 600, 391, 424.5; 60/740, 752

[56] References Cited

U.S. PATENT DOCUMENTS

| | | | |
|---|---|---|---|
| 2,325,495 | 7/1943 | Ferguson | 299/120 |
| 2,482,260 | 9/1949 | Goddard | 299/143 |
| 2,636,778 | 4/1953 | Michelsen | 299/120 |
| 2,762,656 | 9/1956 | Fraser | 60/740 |
| 3,164,200 | 1/1965 | Reed | 158/11 |
| 3,228,612 | 1/1966 | Graham et al. | 239/132.3 |
| 3,317,138 | 5/1967 | Fraser | 239/402.5 X |
| 3,394,888 | 7/1968 | Dasse et al. | 239/424 |
| 3,460,911 | 8/1969 | Krejci et al. | 23/295.5 |
| 3,668,869 | 6/1972 | De Corso et al. | 239/418 |
| 3,758,259 | 9/1973 | Voorheis | 431/9 |
| 3,827,632 | 8/1974 | Rymarchyk et al. | 239/132.3 |
| 3,887,135 | 6/1975 | Tamai | 239/406 |
| 4,011,995 | 3/1977 | Krause, Jr. | 239/404 |
| 4,278,418 | 7/1981 | Strenkert | 431/8 |
| 4,427,367 | 1/1984 | Yagisawa | 431/354 |
| 4,613,079 | 9/1986 | Mains | 239/600 X |
| 4,664,619 | 5/1987 | Johnson et al. | 431/154 |
| 4,678,125 | 7/1987 | Elston | 239/600 X |
| 4,742,959 | 5/1988 | Stanchak et al. | 239/417 X |

FOREIGN PATENT DOCUMENTS

| | | | |
|---|---|---|---|
| 648483 | 8/1937 | Fed. Rep. of Germany | 239/418 |
| 12808 | of 1913 | United Kingdom | 239/419 |
| 566133 | 12/1943 | United Kingdom | 239/403 |

OTHER PUBLICATIONS

Gas Turbine Combustion, pp. 413–431.

*Primary Examiner*—Edward K. Look
*Assistant Examiner*—John Ryznic
*Attorney, Agent, or Firm*—C. Dean Domingue; Neal R. Kennedy

[57] ABSTRACT

A burner nozzle for burning petroleum products. The burner nozzle includes a fluid conduit with an air jacket disposed therearound such that a dead air space is defined therebetween to prevent fluid leakage from entering the air jacket. The burner nozzle comprises a replaceable air jetting assembly which provides an annular stream of air, either cylindrical or conical in configuration, which impinges the fluid stream exiting the nozzle for atomization thereof. The jetting assembly includes a replaceable and interchangeable jetting insert. A swirl chamber is provided in the fluid conduit to impart a swirling motion to fluid flowing therethrough. The swirl chamber is clamped in position on opposite sides thereof so that it is always in compression, thus allowing use of non-weldable materials. One embodiment has a variable air jetting orifice.

14 Claims, 2 Drawing Sheets

BURNER NOZZLE WITH REPLACEABLE AIR JETTING ASSEMBLY

BACKGROUND OF THE INVENTION

1. Field Of The Invention

This invention relates to burner nozzles for burning petroleum products during well testing, and more particularly, to a burner nozzle with a replaceable annular air jet and an oil swirl chamber which is clamped in position such that it is always in compression.

2. Description Of The Prior Art

Burner nozzles in which petroleum products are burned, and in particular to dispose of the products of oil well testing, are well known. U.S. Pat. No. 4,011,995 to Krause discloses a nozzle with petroleum products and air mixed by the nozzle to facilitate burning of the petroleum products. In this device, it is possible for oil to be forced under pressure into the air can or jacket and into the air supply line in the event of rupture of the oil line, an undesirable situation.

U.S. Pat. No. 4,664,619 to Johnson et al. discloses a burner nozzle for mixing petroleum products to be burned with air in which air is injected into a petroleum stream, exiting an oil orifice, from an air jacket or can which is spaced from the oil orifice and its petroleum product supply line such that any leakage of petroleum is directed into a space between the supply line and the air jacket so that the petroleum products cannot be forced under pressure into the air jacket. This burner nozzle utilizes an oil swirl chamber with the oil orifice integral therewith and which is attached to an oil conduit such as by welding. A plurality of air exit holes are defined in a spacer at an end of the air jacket adjacent to the oil orifice. The air exit holes direct air from an annulus in the air jacket into the oil stream. These air jets serve to atomize the oil stream to facilitate burning.

A problem with the prior burner nozzle of Johnson et al. is that the air stream from each of the jets tends to spread the further the air stream is from the nozzle, and this can be so great that the air velocity is reduced sufficiently so that it does not properly atomize the oil stream when it impinges the oil stream. Another problem is that the individual jets do not atomize the oil stream around the complete circumference thereof because the air is jetted from individual holes. This leaves "fingers" of oil between the air jets which do not get atomized or agitated at all which has a detrimental effect on burning. The present invention solves this problem by providing an air jet defining an annular air orifice therein which provides an even stream of air around the circumference of the petroleum stream, thus insuring better atomization and more efficient burning. In one embodiment, the air stream is directed into the petroleum stream substantially simultaneously as the petroleum stream exits the petroleum orifice. This appears to be better for more viscous fluids and/or relatively low flow rates.

U.S. Pat. No 2,325,495 to Ferguson discloses an oil burner with an apparently annular air discharge opening adjacent to a burner tip. The air discharge opening is formed by an integral nozzle portion of an air pipe. The burner of Ferguson does not have a replaceable and interchangeable air jet as does the present invention.

Many apparatus of the prior art utilize welded components which are not easily replaced and which require expensive hardened materials. The present invention allows replacement of many of the components which are subjected to wear from either the petroleum stream or the air stream. The above-referenced patent to Ferguson has a swirl body which has a radially outwardly extending flange which is clamped between an end of an oil pipe and the burner tip. The main portion of the body extends from this flange and is unsupported. In particular, the swirl chamber used in the present invention is clamped on opposite ends so that it is always in compression which allows use of materials such as ceramics which provide long service life, but which cannot be used in situations where the components are welded or are in tension. No portion of the swirl chamber of the present invention extends unsupported as in the Ferguson apparatus, and thus the present swirl chamber is less subject to vibration and possible fatigue problems associated therewith.

SUMMARY OF THE INVENTION

The burner nozzle of the present invention is adapted for burning petroleum products or the like and comprises petroleum orifice means for forming a petroleum stream and directing the petroleum stream therefrom and a replaceable air jetting means defining a substantially annular jetting orifice therein for forming an air stream and directing the air stream into impingement with the petroleum stream, thereby facilitating atomization of the petroleum stream. A means may be provided for varying the size of the jetting orifice.

The jetting orifice is preferably substantially concentric with the petroleum orifice means and positioned such that the air stream may impinge the petroleum stream as the petroleum stream is discharged from the petroleum orifice means or substantially simultaneously impinge the petroleum stream as the petroleum stream is discharged from the petroleum orifice means. The air jetting means may be configured such that the air stream is substantially cylindrical and extends in substantially the same direction as an axis of the petroleum orifice means. The air jetting means may also be configured such that the jetting orifice is substantially conical and directs a conical stream of air toward the petroleum stream. Preferably, the air stream has a velocity which is substantially nearly sonic velocity.

The petroleum orifice means may be characterized by a petroleum orifice connected to a petroleum tube or conduit portion which in turn is attachable to a petroleum fluid source. The petroleum orifice defines an orifice opening therein which directs the fluid therefrom. A replaceable wear insert may be used in the petroleum orifice.

Preferably, the air jetting means is characterized as an air jet attached to an air jacket which is disposed around at least portions of the petroleum orifice and the tube portion. The air jacket is spaced outwardly from the petroleum orifice such that a substantially annular dead air space is defined therebetween. This dead air space prevents petroleum which might leak from the apparatus from entering the air jacket.

The air jet preferably comprises an insert holder attached to the air jacket and defining an annular space therein, and a replaceable and interchangeable insert disposed in the insert holder such that the annular air jetting orifice is defined between the insert and a surface of the insert holder.

In a preferred embodiment, the burner nozzle further comprises a petroleum swirling chamber whereby petroleum fluid flowing from the tube portion to the petroleum orifice is directed to move with a swirling motion and clamping means for clamping the swirl chamber on opposite sides thereof in an operating position adjacent to the tube portion such that the chamber is held in compression. The clamping means also holds the wear insert in the petroleum orifice when a wear insert is used. The clamping means may comprise a shoulder in the tube portion and a portion of the petroleum orifice such that the petroleum orifice engages the swirl chamber and clamps it toward the shoulder. A spacer may be disposed between the swirl chamber and the shoulder.

The burner nozzle may also comprise petroleum conduit means for connecting to a petroleum source, of which the petroleum tube portion, swirl chamber and orifice may form a part, and air conduit means in communication with an air passage in the air jacket for connecting to an air source.

An important object of the invention is to provide a burner nozzle for petroleum products which has a replaceable air jet defining an annular jetting orifice therein for directing an air stream into impingement with a petroleum stream for atomization of the petroleum stream.

Another object of the invention is to provide a burner nozzle with replaceable wear components.

An additional object of the invention is to provide a burner nozzle which has a fluid swirl chamber clamped on opposite sides thereof in a position such that it is always in compression.

A further object of the invention is to provide a burner nozzle having a dead air space between a petroleum conduit means and an air jacket means disposed therearound such that leakage from the petroleum conduit will not enter the air jacket means.

A still further object of the invention is to provide a burner nozzle with an interchangeable air jetting means.

Additional objects and advantages of the invention will become apparent as the following detailed description of the preferred embodiments is read in conjunction with the drawings which illustrate such preferred embodiments.

DESCRIPTION OF THE PREFERRED EMBODIMENT

Figure 1:
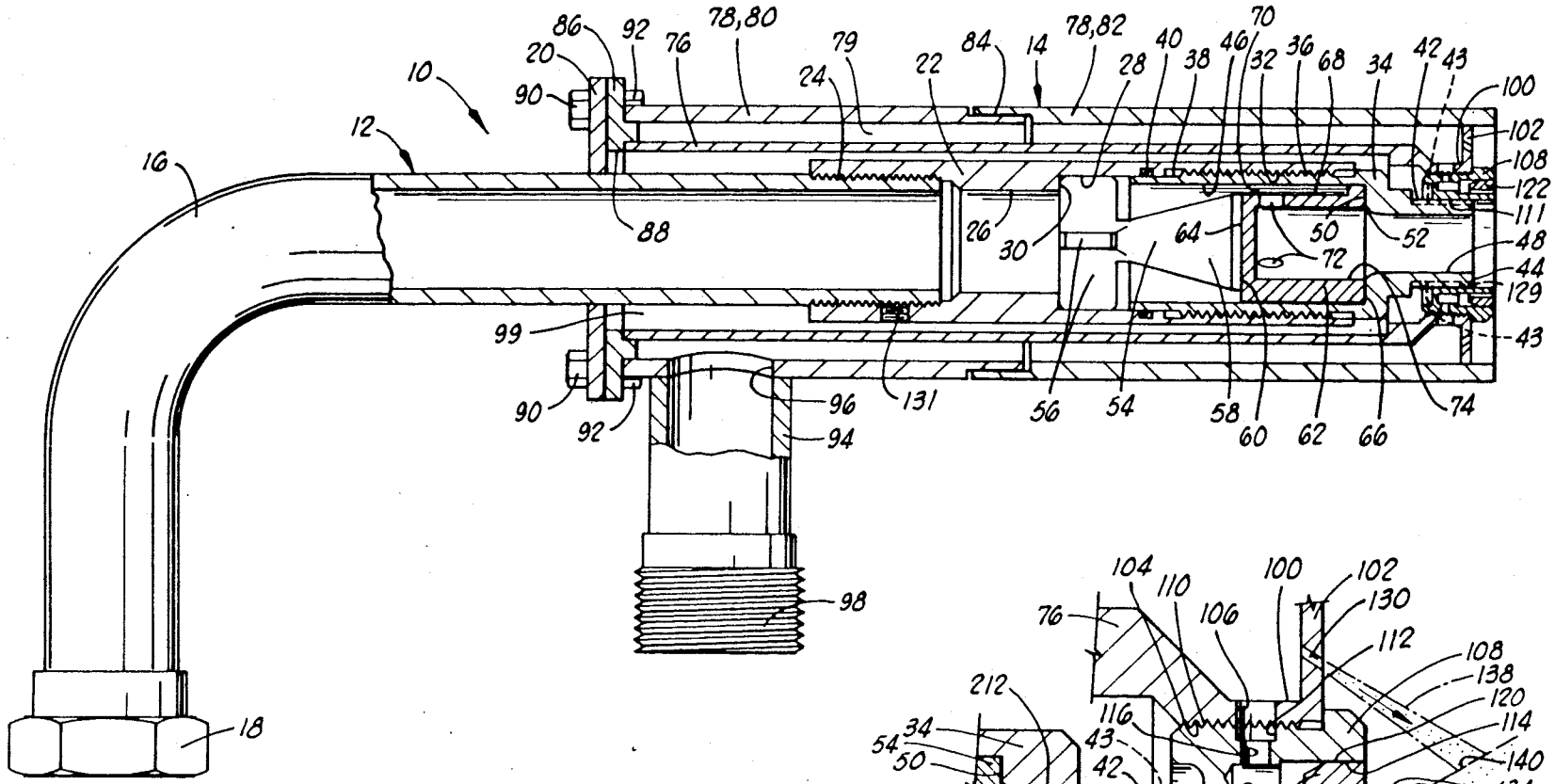
FIG. 1 is a partial longitudinal cross-sectional view of a first embodiment of the burner nozzle of the present invention.

Referring now to the drawings, and more particularly to FIG. 1, a first embodiment of the burner nozzle of the present invention is shown and generally designated by the numeral 10. Burner 10 generally comprises a fluid or petroleum conduit means 12 with air jacket, can or chamber means 14 disposed around a portion of the fluid conduit means.

Fluid conduit means 12 includes a generally tubular fluid or petroleum conduit 16 which is adapted for connection to a petroleum supply (not shown) by any fastening means known in the art such as a pipe union nut 18. A mounting flange 20 is disposed around conduit 16 and extends radially outwardly therefrom. Mounting flange 20 is fixedly attached to conduit 16 by a means known in the art, such as welding.

A petroleum tube or conduit adapter means is provided for connecting to fluid conduit means 12. The petroleum tube adapter means may be characterized by a petroleum tube adapter 22 which is connected to conduit 16 at threaded connection 24. Tube adapter 22 defines a first bore 26 and a second bore 28 therein with a generally annular shoulder or shouldering surface 30 extending therebetween. At an end of tube adapter 22 opposite from threaded connection 24, the tube adapter defines a threaded bore 32 therein.

A petroleum orifice means for forming a petroleum stream and directing the petroleum stream therefrom may be attached to tube adapter 22. The petroleum orifice means may be characterized by a petroleum orifice 34 which has a threaded diameter 36 adapted for engagement with threaded bore 32 in tube adapter 22. Orifice 34 has an outside diameter 38 which is in close spaced relationship with second bore 28 in tube adapter 22. A sealing means, such as O-ring 40, provides sealing engagement between tube adapter 22 and orifice 34.

Because tube adapter 22 and orifice 34 form significant portions of the oil flow path through burner nozzle 10, the tube adapter and orifice may be considered part of fluid conduit means 12.

Orifice 34 also has a hexagonal outside portion 42 with flats 43 thereon. Hexagonal portion 42 has a longitudinally outer end 44.

Orifice 34 defines a first bore 46 therein and a smaller second bore 48 with a generally annular shoulder 50 extending therebetween. It will be seen by those skilled in the art that second bore 48 forms the actual orificing diameter or petroleum outlet of orifice 34. At a longitudinally inner end of second bore 48, an annular radius 52 is formed which blends between shoulder 50 and second bore 48.

Dispose within tube adapter 22 and orifice 34 is a spacer 54. At a longitudinally inner end of spacer 54 is a plurality of guide fins 56. Guide fins 56 rest against shoulder 30 and are in closed relationship to second bore 28 in tube adapter 22. The longitudinally outer end of spacer 54 has a conical portion 58 with a longitudinally outwardly facing bearing surface 60 thereon.

A petroleum swirl chamber 62 having opposite ends 64 and 66 is disposed within tube adapter 22 and orifice 34 and is clamped by orifice 34 against spacer 54. That is, shoulder 50 in orifice 34 bears against end 66 of swirl chamber 62, and end 64 of the swirl chamber bears against surface 60 of spacer 54. Thus, a clamping means is provided for clamping swirl chamber 62 in an operating position.

It will be seen that swirl chamber 62 is an individual, separable component which is always in compression because it is clamped in place. This allows swirl chamber 62 to be manufactured of various materials, including materials which have limited tensile strength or which are non-weldable, such as ceramics.

A plurality of flats 68 are formed on swirl chamber 62 such that an annular impingement chamber 70 is defined between each flat 68 and first bore 46 of orifice 34. A plurality of off-center holes or ports 72 are defined in swirl chamber 62, thus providing communication between impingement chambers 70 and bore 74 in the swirl chamber. Each hole 72 is preferably substantially perpendicular to a flat 68.

As will be further described herein, fluid flowing from conduit 16 will enter tube adapter 22, flow past fins 56 and conical portion 58 of spacer 54, into impingement chambers 70 and through holes 72 which impart a swirling motion to fluid entering bore 74 of swirl chamber 62. This swirling motion continues as the fluid flows through second bore 48 of orifice 34 and as the fluid is discharged from burner nozzle 10. It will be seen that swirl chamber 62 also thus forms a portion of fluid conduit means 12. The positioning of off-center holes 72 in swirl chamber 62 and the swirling motion imparted to the fluid flowing therethrough are in a manner known in the art.

As already indicated, air jacket means 14 is disposed around fluid conduit means 12, and it will be seen that the air jacket means encloses at least portions of conduit 16, tube adapter 22 and orifice 34. Preferably, air jacket means 14 is concentric with these portions of fluid conduit means 12.

Air jacket means 14 comprises an inner jacket tube 76 and an outer jacket tube 78 spaced radially outwardly from the inner jacket tube. Thus, an air annulus or passageway 79 is defined between inner jacket tube 76 and outer jacket tube 78.

Outer jacket tube 78 includes a first portion 80 and a second portion 82 longitudinally outwardly of the first portion. First and second portions 80 and 82 of outer jacket tube 78 are slidably connected at a slip joint 84.

Inner jacket tube 76 and outer jacket tube 78 are fixedly attached to an end plate 86 as by welding. It will be seen that end plate 86 closes off one end of air annulus 79. End plate 86 has a bore 88 therethrough which is preferably approximately the same size as the inside diameter of inner jacket tube 76. End plate 86 is adapted for attachment to mounting flange 20 by any fastening means known in the art, such as bolts 90 and nuts 92.

An air conduit means, such as an air conduit 94, is provided for connecting to an air supply (not shown) and placing the air supply in communication with air annulus 79. Air conduit 94 is attached to first portion 80 of outer jacket tube 78 by any known means such as welding. Air conduit 94 is aligned with a hole 96 in first portion 80. In the embodiment shown, air conduit 94 has a threaded portion 98 adapted for connection to a pipe union on the air supply, but the particular configuration of air conduit 94 and its connection to the air supply is not intended to be limited to the configuration shown.

Inner jacket tube 76 of air jacket means 14 is spaced radially outwardly from fluid conduit means 12 such that a dead air annulus 99 is defined therebetween. Dead air annulus 99 insures that fluid leaking from fluid conduit means 12 will not enter air annulus 79 or any other internal portion of air jacket means 14.

Figure 2:
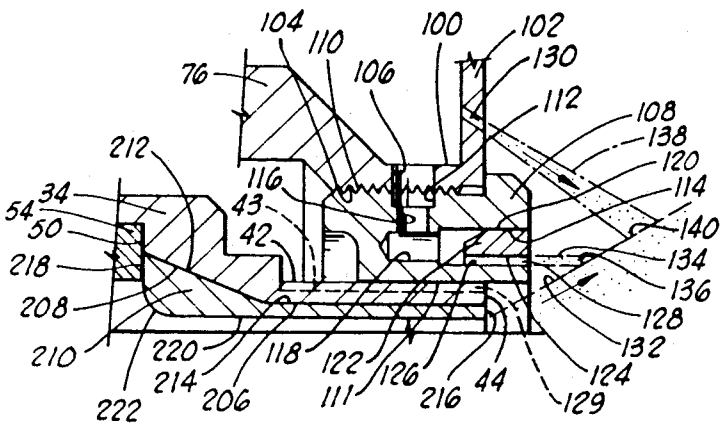
FIG. 2 is an enlarged detail of the air jet portion of the burner nozzle in FIG. 1 and also showing an alternate petroleum orifice configuration.

At the longitudinally outer end of inner jacket tube 76 is a reduced diameter or neck portion 100. Referring now also to FIG. 2 which shows the area of burner nozzle 10 around neck portion 100 of inner jacket tube 76 in enlarged detail, it will be seen that a radially outwardly directed spacer 102 extends from neck portion 100. The outside diameter of spacer 102 is attached to second portion 82 of outer jacket tube 78 by any known means, such as welding.

Neck portion 100 of inner jacket tube 76 defines a threaded bore 104 therein with a plurality of radially oriented holes or ports 106 extending therethrough substantially perpendicular to threaded bore 104.

An air jet tip insert holder 108 has a threaded surface 110 threadingly engaged with threaded bore 104 in neck portion 100 of inner jacket tube 76. Insert holder 108 defines a bore 111 therein. Insert holder 108 further defines an outwardly facing annular groove 112 therein which is in communication with holes 106 and a longitudinally outwardly facing annular groove 114. Radial holes 116 and longitudinal holes 118 provide communication between annular grooves 112 and 114.

An outer surface 120 of a jetting insert 122 is press-fit into annular groove 114 in insert holder 108. Insert 122 has a jetting bore 124 which is spaced outwardly from inside surface 126 of annular groove 114 such that a substantially annular jetting orifice 128 is defined therebetween. Air supplied to air annulus 79 under pressure will be seen to be jetted from burner nozzle 10 through jetting orifice 128, thus providing an air jetting means.

It will be seen by those skilled in the art that flats 43 on petroleum orifice 34 form a path 129 adjacent to bore 111 in insert holder 108 which allows venting and draining of dead air annulus 99. Thus, any petroleum which leaks into dead air annulus 99 cannot build up.

In one embodiment, a plurality of holes or orifices 130 are defined through spacer 102. Holes 130 are preferably angled such that they converge on a longitudinal axis of fluid conduit means 12 at a distance spaced outwardly from fluid orifice 34. As will be discussed further herein, holes 130 may not necessarily be required, and the invention is not intended to be limited to a burner nozzle having these holes.

FIG. 2 also shows an alternate embodiment of petroleum orifice 34. In this embodiment, orifice 34 has a bore 206 with a tapered bore 208 at the longitudinally inner end of bore 206. An orifice wear insert 210 having a tapered outer surface 212 and a substantially cylindrical outer surface 214 is disposed in orifice 34. Cylindrical outer surface 214 on insert 210 is in close spaced relationship with bore 206 in orifice 34, and tapered outer surface 212 on the insert is positioned adjacent to tapered bore 208 in the orifice. Wear insert 210 has a longitudinally outer end 216 substantially aligned with end 44 of orifice 34 and a longitudinally inner end 218 substantially aligned with shoulder 50 in orifice 34.

Wear insert 210 has a bore 220 therethrough with an annular radius 222 on the radially inner end thereof. Radius 222 corresponds to radius 52 in the embodiment shown in FIG. 1, and bore 220 corresponds to second bore 48 in FIG. 1. Thus, it will be seen that bore 220 is the actual orificing diameter of the nozzle when wear insert 210 is used.

When petroleum orifice 34 is threaded into engagement with tube adapter 22, thus clamping swirl chamber 62 in place as already described, it will be seen that this clamping means also serves to hold wear insert 210 in place. That is, swirl chamber 54 bears against inner end 218 of wear insert 210 so that tapered surface 212 of the wear insert bears against tapered bore 208 in orifice 34.

During assembly of burner nozzle 10, O-ring 40 is positioned in tube adapter 22. Tube adapter 22 is then torqued onto conduit 16. A plurality of set screws 131 are used to lock tube adapter 22 to conduit 16. After tube adapter 22 is locked into place, spacer 54 is inserted into the tube adapter, and swirl chamber 62 is then positioned in tube adapter 22. Wear insert 210, if used, is positioned in orifice 34, and the orifice is threaded into tube adapter 22 to clamp swirl chamber 62, spacer 54 and wear insert 210 in place. Hexagonal portion 42 of orifice 34 is adapted for engagement by a socket wrench and thus serves to facilitate the threading engagement of orifice 34 with tube adapter 22.

Air jacket means 14 may then be positioned over orifice 34, tube adapter 22 and a portion of conduit 16 as shown in FIG. 1 such that end plate 86 is adjacent to mounting flange 20. Alternatively, air jacket means 14 may be installed prior to the installation of spacer 54, swirl chamber 62 and orifice 34. End plate 86 of air jacket means 14 is fastened by bolts 90 and 92 to mounting flange 20. The inside diameter of inner jacket tube 76 and bore 88 of end plate 86 are sized such that they will fit over the components of fluid conduit means 12.

After air jacket means 14 is in place, the air jetting means or assembly including insert holder 108 and jetting insert 122 is threaded into threaded bore 104 of inner jacket tube 76. The outer end of insert holder 108 may also have a hexagonal configuration (not shown), similar to hexagonal portion 42 of orifice 34, adapted for engagement by a socket wrench to facilitate threading.

OPERATION OF THE INVENTION

After conduit 16 is connected to the petroleum fluid source and air conduit 94 is connected to the air source, fluid is flowed through fluid conduit means 12 in a manner briefly described previously herein. That is, the fluid flows through conduit 16 into tube adapter 22, past spacer 54 into impingement chambers 70. The fluid then passes through holes 72 at which point a swirling motion is imparted to the fluid. The swirling fluid flows out of bore 74 in swirl chamber 62 and continues to swirl through second bore 48 in orifice 34 or bore 220 of wear insert 210 if provided. The swirling fluid exits bore 48 of orifice 34 or bore 220 of wear insert 210 (see FIG. 2) and tends to spread to form a swirling, conical stream of fluid 132.

Air is supplied through air conduit 94 into air annulus 79 under pressure. The air thus is supplied through holes 106, annular groove 112, holes 116 and 118, annular groove 114 and discharged from burner nozzle 10 through annular jetting orifice 128 to form a near sonic, annular stream of air 134 which impinges fluid stream 132 at a longitudinally spaced location generally indicated by reference numeral 136.

In the alternate configuration in which angled holes 130 are included in spacer 102, it can be seen that a plurality of conical air streams 138 will be discharged from holes 130 and impinge fluid stream 132 at a location generally indicated by reference numeral 140. Preferably, conical air streams 138 will impinge fluid stream 132 downstream from impingement location 136.

ALTERNATE EMBODIMENTS

Figure 3:
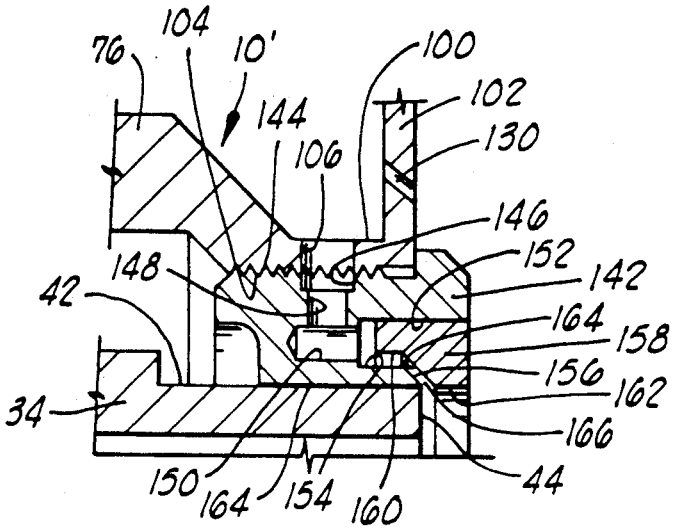
FIG. 3 is an enlarged detail of an alternate embodiment of the air jet portion.

Referring now to FIG. 3, an alternate embodiment 10' of the burner nozzle of the present invention is shown. FIG. 3 generally corresponds to FIG. 2 in that it shows an enlarged detail of the area adjacent to neck portion 100 of inner jacket tube 76. The first described petroleum orifice 34 is shown in FIG. 3 without a wear insert 210. In the embodiment of FIG. 3, a different jetting insert holder 142 has a threaded surface 144 which is engaged with threaded bore 104 of neck portion 100. Insert holder 142 has an annular groove 146, radial holes 148 and longitudinal holes 150 which are substantially identical to annular groove 112, radial holes 116 and longitudinal holes 118 in insert holder 108 of first embodiment 10. In embodiment 10', however, a longitudinally outwardly facing cavity 152 is formed in insert holder 142. Cavity 152 is formed in part by an inner, substantially cylindrical surface 154 with a chamfered surface 156 facing outwardly therefrom. A jetting insert 158 is pressed into cavity 152. Jetting insert 158 has a first bore 160 spaced radially outwardly from inner surface 154 of insert holder 142 and a smaller second bore 162 which, in FIG. 3, is shown to be approximately the same diameter as bore 164 in insert holder 142, although the invention is not intended to be so limited. An angled surface extends between first and second bores 160 and 162 in jetting insert 158 and is spaced away from chamfered surface 156 of insert holder 142 so that an angularly disposed jetting orifice 166 is defined therebetween.

In alternate embodiment 10', fluid is discharged from orifice 34 or wear insert 210 in substantially the same manner as in first embodiment 10. However, in alternate embodiment 10', a near sonic jetted stream of air exits jet 166 in a conical pattern so that it impinges the fluid stream at a location nearer to the apparatus, preferably immediately adjacent to end 44 of orifice 34. Thus, it may be said that the air stream impinges the fluid stream substantially simultaneously as the fluid stream exits orifice 34. Because the jetted air stream more directly impinges the petroleum fluid stream and is closer thereto, there is more impact by the air on the fluid stream. It is believed that this will be particularly effective for more viscous fluids and/or for low fluid flow rates, although it is not intended that these conditions be a limitation on the invention.

As with first embodiment 10, holes 130 in spacer 102 may also be retained from the prior art to further agitate and atomize the fluid stream as it exits nozzle 10'.

Figure 4:
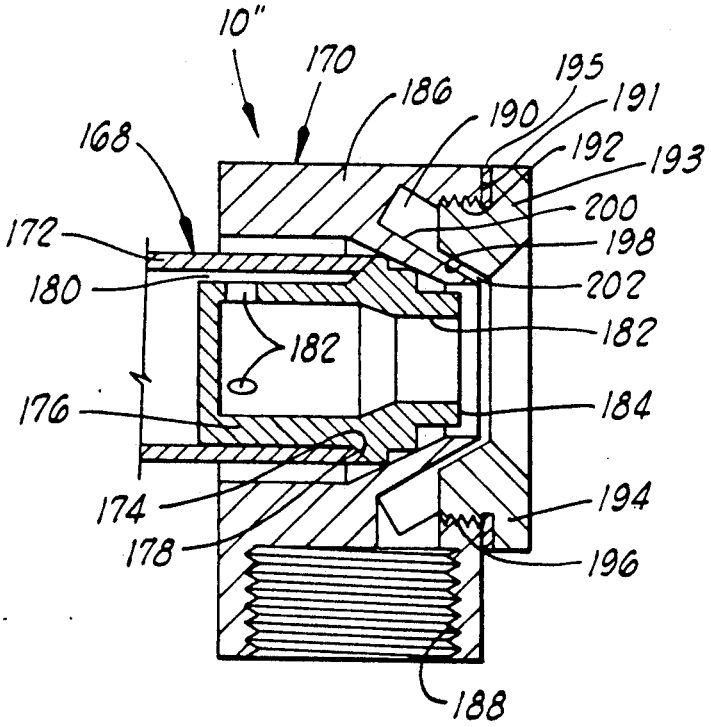
FIG. 4 illustrates another alternate embodiment of the burner nozzle of the present invention.

Referring now to FIG. 4, a second alternate embodiment of the burner nozzle of the present invention is shown and generally designated by the numeral 10''. In this embodiment, there is again a fluid conduit means 168 and an air conduit and jacket means 170.

Fluid conduit means 168 includes a tube adapter 172 which may be connected to a conduit in the same manner that tube adapter 22 is connected to conduit 16 in the first embodiment. Tube adapter 172 has an inwardly facing chamfered surface 174.

A combination fluid swirl chamber-fluid orifice 176 has an outwardly angled surface 178 which is adapted for engagement with chamfered surface 174 in tube adapter 172. As will be further discussed herein, chamber-orifice 176 is clamped into this position by air conduit means 170.

A plurality of impingement chambers 180 are defined between tube adapter 172 and a corresponding plurality of flats 181 on chamber-orifice 176. Each impingement chamber 180 is in communication with off-center holes 182, similar to holes 72 in the first embodiment. Chamber-orifice 176 defines a bore 182 which forms the actual orifice directing fluid out of burner 10'' at longitudinally outer end 184 of chamber-orifice 176. Fluid flowing through fluid conduit means 168 is swirled by holes 182 and discharges from end 184 in a swirling cone similar to the other embodiments.

Air conduit means 170 includes an air housing 186 with a threaded bore 188 adapted for connection to an air source of a kind known in the art. The attachment of air housing 186 to fluid conduit means 168 is not specifically shown and may be by any means known in the art.

Air housing 186 defines an annular, angled groove 190 with a threaded bore 192 adjacent thereto and a longitudinally outer end 191. A jetting insert 194 has a threaded surface 196 adapted for engagement with threaded bore 192 in air housing 186 and a radially outward flange 193. Jetting insert 194 also has an angled inner bore 198 which is spaced away from surface 200 in groove 190 such that an angled jetting orifice 202 is formed therebetween. If desired, the cross-sectional area of jetting orifice 202 may be varied by positioning one or more shims 195 between flange 193 on jetting insert 194 and end 191 of air housing 186. In this way, the size of orifice 202 may be varied to accommodate variations in capacity of the air source. For example, the larger capacity of rig air, rather than a portable compressor, may make it desirable to increase the size of orifice 202. Thus, a means is provided for varying the orifice size.

In the alternate embodiment of FIG. 4, it will be seen that air supplied to annular groove 190 from the air source will be jetted in a conical pattern similar to that of the first alternate embodiment 10' shown in FIG. 3. That is, in second alternate embodiment 10'', the air stream more directly impinges the fluid stream than in the first embodiment. However, as shown in FIG. 4, the air stream impinges the fluid stream at a distance further from the outlet of the orifice 184 than in the embodiment of FIG. 3.

All of the embodiments utilize replaceable and interchangeable components and provide an annular air jetting means which directs an annular stream of air, either cylindrical or conical in configuration, toward the fluid stream exiting the burner nozzle.

It can be seen, therefore, that the burner nozzle of the present invention is well adapted to carry out the ends and advantages mentioned as well as those inherent therein. While several preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. A petroleum burner nozzle for use with a petroleum supply, said nozzle comprising:

petroleum orifice means for forming and directing a petroleum stream from said petroleum source, said petroleum orifice means defining a central bore through which said petroleum stream is discharged;

an air jacket disposed around said petroleum orifice means; and an air jet removably attached to said air jacket and defining a substantially annular jetting orifice for forming an air stream and directing said air stream into impingement with said petroleum stream for facilitating atomization of said petroleum stream.

2. The nozzle of claim 1 further comprising means for varying the size of said jetting orifice.

3. The nozzle of claim 1 wherein said jetting orifice is an annular orifice which is substantially conical.

4. The nozzle of claim 1 wherein said air stream impinges said petroleum stream substantially simultaneously as said petroleum stream is discharged from said petroleum orifice.

5. The nozzle of claim 1 wherein said air stream has a velocity substantially nearly sonic velocity.

6. The nozzle of claim 1 wherein said air jacket is spaced outwardly from said petroleum orifice such that a substantially annular space is defined therebetween.

7. A burner nozzle comprising:

petroleum conduit means for connecting to a petroleum source;

petroleum adapter means for connecting to said petroleum conduit means and defining a shouldering surface;

a petroleum swirling chamber disposed adjacent to said petroleum adapter means whereby a swirling motion is imparted to petroleum flowing through said petroleum adapter means;

a petroleum orifice attached to said petroleum adapter means and having means for clamping said swirling chamber toward said shouldering surface, said petroleum orifice defining a petroleum outlet therein from which a petroleum stream is discharged;

an air jacket disposed around at least a portion of said petroleum adapter means and at least a portion of said petroleum orifice, said air jacket defining an air passage therein;

air conduit means in communication with said air passage for connecting to an air source; and air jetting means defining a substantially annular air jetting orifice therein for jetting air from said air jacket and impinging said petroleum stream for atomization thereof, said air jetting means being removably connected to said air jacket.

8. The nozzle of claim 7 wherein said air stream impinges said petroleum stream substantially simultaneously as said petroleum stream is discharged from said petroleum orifice.

9. The nozzle of claim 7 wherein said air jetting means discharges air at substantially nearly sonic velocity.

10. A petroleum burner nozzle for use with a petroleum supply, said nozzle comprising:

petroleum orifice means for directing a petroleum stream from said petroleum supply; and a replaceable air jet attached to an air jacket disposed around said petroleum orifice means and defining a substantially annular jetting orifice for forming an air stream and directing said air stream into impingement with said petroleum stream for facilitating atomization of said petroleum stream, said air jet comprising:

an insert holder attached to said air jacket and defining an annular space therein; and an insert disposed in said insert holder such that said annular air jetting orifice is defined between said insert and a surface of said insert holder.

11. A burner nozzle comprising:

a tube portion attachable to a fluid source;

an orifice connected to said tube portion and defining an orifice opening therein which directs fluid therefrom;

a swirling chamber whereby fluid flowing from said tube portion to said orifice is directed to move with a swirling motion;

clamping means for clamping said swirling chamber on opposite sides thereof in an operating position adjacent to said tube portion such that said swirling chamber is held in compression, said clamping means comprising:

a shoulder in said tube portion; and a portion of said orifice such that said orifice engages said swirling chamber and clamps it toward said shoulder;

a spacer disposed between said swirling chamber and said shoulder; and air jetting means adjacent to said tube portion for directing a stream of air to said fluid flowing from said orifice.

12. A burner nozzle comprising:

petroleum conduit means for connecting to a petroleum source;

petroleum adapter means for connecting to said petroleum conduit means and defining a shouldering surface;

a petroleum swirling chamber disposed adjacent to said petroleum adapter means whereby a swirling motion is imparted to petroleum flowing through said petroleum adapter means;

a petroleum orifice attached to said petroleum adapter means and having means for clamping said chamber toward said shouldering surface, said petroleum orifice comprising a removable wear insert therein which defines a petroleum outlet from which a petroleum stream is discharged;

an air jacket disposed around at least a portion of said petroleum adapter means and at least a portion of said petroleum orifice, said air jacket defining an air passage therein;

air conduit means in communication with said air passage for connecting to an air source; and air jetting means for jetting air from said air chamber and impinging said petroleum stream for atomization thereof.

13. A burner nozzle comprising:

petroleum conduit means for connecting to a petroleum source;

petroleum adapter means for connecting to said petroleum conduit means and defining a shouldering surface;

a petroleum swirling chamber disposed adjacent to said petroleum adapter means whereby a swirling motion is imparted to petroleum flowing through said petroleum adapter means;

a petroleum orifice attached to said petroleum adapter means and having means for clamping said chamber toward said shouldering surface, said petroleum orifice defining a petroleum outlet therein from which a petroleum stream is discharged;

an air jacket disposed around at least a portion of said petroleum adapter means and at least a portion of said petroleum orifice, said air jacket defining an air passage therein, wherein an inner portion of said air jacket is spaced radially outwardly from outer portions of said petroleum adapter means and said petroleum orifice;

air conduit means in communication with said air passage for connecting to an air source; and air jetting means for jetting air from said air chamber and impinging said petroleum stream for atomization thereof.

14. A burner nozzle comprising:

petroleum conduit means for connecting to a petroleum source;

petroleum adapter means for connecting to said petroleum conduit means and defining a shouldering surface;

a petroleum swirling chamber disposed adjacent to said petroleum adapter means whereby a swirling motion is imparted to fluid flowing through said petroleum adapter means;

a petroleum orifice attached to said petroleum adapter means and having means for clamping said swirling chamber toward said shouldering surface, said petroleum orifice defining a petroleum outlet therein from which a petroleum stream is discharged;

an air jacket disposed around at least a portion of said petroleum adapter means and at least a portion of said petroleum orifice, said air jacket defining an air passage therein;

air conduit means in communication with said air passage for connecting to an air source; and air jetting means for jetting air from said air chamber and impinging said petroleum stream for atomization thereof, said air jetting means comprising:

an insert holder attached to said air jacket and defining an annular space therein; and an insert disposed in said insert holder such that a substantially annular air jetting orifice is defined therebetween.

* * * * *